United States Patent [19]

King et al.

[11] Patent Number: 4,485,633

[45] Date of Patent: Dec. 4, 1984

[54] TEMPERATURE-BASED CONTROL FOR ENERGY MANAGEMENT SYSTEM

[75] Inventors: Eddie W. King, Atlanta; Robert D. Hughes, IV, Smyrna, both of Ga.

[73] Assignee: The Coca-Cola Company, Atlanta, Ga.

[21] Appl. No.: 434,862

[22] Filed: Oct. 18, 1982

[51] Int. Cl.[3] ..... F25D 17/00

[52] U.S. Cl. ..... 62/180; 62/203; 62/209

[58] Field of Search ..... 62/180, 186, 203, 209

[56] References Cited

U.S. PATENT DOCUMENTS

| | | | |
|---|---|---|---|
| 3,373,577 | 3/1968 | Bohman | 62/186 X |
| 3,381,488 | 5/1968 | Lewis | 62/203 X |
| 3,404,072 | 10/1968 | Bollen et al. | 203/1 |
| 3,600,283 | 8/1971 | Bollen et al. | 203/1 |
| 3,803,863 | 4/1974 | Jednacz et al. | 62/209 |
| 4,304,293 | 12/1981 | Scheiwe et al. | 236/15 BB |

FOREIGN PATENT DOCUMENTS

| | | | |
|---|---|---|---|
| 56-113939 | 9/1981 | Japan | 62/180 |

OTHER PUBLICATIONS

*Hydrocarbon Processing* Magazine, published by Gulf Publishing Company, vol. 60, No. 11, pp. 129–132 (Nov. 1981).

*Primary Examiner*—William E. Wayner

*Attorney, Agent, or Firm*—Birch, Stewart, Kolasch & Birch

[57] ABSTRACT

A refrigeration system for a chilled-product vending machine including a refrigeration compressor, a temperature sensor for detecting the temperature within said vending machine and turning the compressor ON and OFF to define a compressor cycle in response to the detection of predetermined temperature limits, an evaporator coil and evaporator fan means for blowing air across said evaporator coil and circulating said air throughout the vending machine. The system further includes a temperature-based responsive control circuitry including a product sensor for detecting the temperature of the chilled products and cycling said evaporator fan ON in response to detected product temperatures above a predetermined limit, the predetermined limit being less than the temperature required to torn the compressor ON, and a coil sensor for detecting the temperature below a predetermined limit, maintaining said evaporator fan ON during and beyond the end of the compressor cycle, and cycling the evaporator fan OFF when the temperature of the coil stabilizes above the freezing point of water.

5 Claims, 4 Drawing Figures

TEMPERATURE-BASED CONTROL FOR ENERGY MANAGEMENT SYSTEM

BACKGROUND OF THE INVENTION

1. Field of the Invention

The present invention relates to an energy conservation and refrigeration control system for chilled-product vending machines. More specifically, the present invention relates to a control circuit for a forced air type refrigeration system for a vending machine which dispenses chilled products such as beverage cans or bottles.

2. Description of the Prior Art

Heretofore, in refrigeration systems of vending machines including a compressor, a condensor, condensor coil, condensor fan motor, evaporator coil and an evaporator fan, the compressor has been cycled ON and OFF under the control of a thermostat, and the evaporator fan, which blows air over the evaporator coil to circulate chilled air throughout the vending machine, has been run continuously even during the periods when the compressor was OFF. The unnecessary high energy useage and waste caused by the continuous running of the evaporator fan or fans, has become a problem with the current high cost of energy. One logical solution to reducing the consumption of energy is to cycle the evaporator fan motor ON and OFF with the compressor thus decreasing the running time of the evaporator fan. However, this approach causes several problems, which have been discussed in co-pending U.S. application Ser. No. 198,172 filed Oct. 17, 1980 by Morgan and King and assigned to the same assignee as the present invention. Application Ser. No. 198,172 stands abandoned in favor of Continuation Application Ser. No. 466,959, filed Feb. 16, 1983 which is now U.S. Pat. No. 4,467,617.

Firstly, if the evaporator fan is cycled off in synchronism with the turning OFF of the compressor, freeze-up of the evaporator coil can occur in humid, high temperature conditions. Secondly, by keeping the evaporator fan shut off during the compressor off cycles, large variations in temperature in the vending machine occur, creating large variations in temperature of the next to be vended products. Also, during this off period of the evaporator fan, large variations of temperature occur throughout the vending machine due to lack of air flow, and temperatures sensed by the thermostat which controls the compressor cycling are less accurate than desirable. Thirdly, when vending machines are located in below freezing environments (32° F.), an idle condition of the evaporator fan may permit the chilled products to freeze. That is, when the evaporator fan is running and blowing air over the evaporator coil and throughout the vending machine, this flow of air dissipates heat generated by the evaporator fan motors thus acting as a heater to prevent the stored products from freezing. Thus, the aforementioned problems exist when the evaporator fan is permitted to cycle on and off with the compressor, even though a substantial reduction in energy consumption results.

Accordingly, prior to the invention described in the aforementioned co-pending application of Morgan, et al., a need in the art existed for a system which would reduce the consumption of energy in the refrigeration system of a vending machine, but at the same time solve the aforementioned problems of evaporator coil freeze-up in high, humid temperature conditions; product freeze-up in below freezing environmental conditions; and large variations in next to be vended products and temperature distribution throughout the vending machine. In the system invented by Morgan, et al. these functions are controlled by electromechanical timers which vary the operating cycle of the evaporator fan to effect a solution to the aforementioned problems.

A modification of the Morgan, et al. system for effecting the same and additional controls for refrigeration systems of chilled-product vending machines was implemented by use of a microprocessor. These modifications are described in co-pending U.S. application Ser. No. 363,961 filed Mar. 31, 1982 by Morgan and King assigned to the same assignee of the present invention, which is now U.S. Pat. No. 4,417,450.

The disclosures of the aforementioned U.S. applications Ser. Nos. 198,172 and 363,961 to Morgan, et al. are incorporated herein by reference.

SUMMARY OF THE INVENTION

The present invention is a further modification to the inventions of the aforemented applications which performs most of the primary functions under the control of a pair of temperature sensors rather than electromechanical timers or microprocessors.

Accordingly, it is a primary object of the present invention to provide an energy mangement and refrigeration control system for a vending machine which conserves energy but still maintains efficient and accurate cooling of the vended products within acceptable limits.

It is a further object of the present invention to provide an energy management system for a vending machine which conserves energy but precludes freeze-up of the evaporator coil in high, humid temperature conditions.

It is another object of the present invention to provide an energy mangement system for a vending machine whereby the vended products dispensed are within acceptable and predictable temperature ranges.

It is still another object of the present invention to provide an energy mangement system for a vending machine wherein temperature fluctuations throughout the refrigerated portion of the vending machine are kept to a minimum.

It is yet another object of the present invention to provide an energy management system for a vending machine whereby product freeze-up is precluded when the vending machine is located in below-freezing environments.

The objects of the present invention are fulfilled by providing a refrigeration system for a chilled-product vending machine including a refrigeration compressor, temperature sensor means for detecting the temperature within said vending machine and turning said compressor ON and OFF to define a compressor cycle in response to the detection of predetermined temperature limits, an evaporator coil and evaporator fan means for blowing air across said evaporated coil and circulating said air throughout the vending machine. The present invention further includes temperature-based responsive control circuitry including a product sensor means for detecting the temperature of said chilled products and cycling said evaporator fan ON in response to detected product temperatures above a predetermined limit, said predetermined limit being less than the temperature required to turn said compressor ON; and coil sensor means for detecting the temperature of said evaporator coil, and responsive to a coil temperature below a predetermined limit, maintaining said evaporator fan ON during and beyond the end of said compressor cycle, and cycling said evaporator fan OFF when the temperature of said coil stabilizes above the freezing point of water.

The temperature limits selected to be sensed and controlled by the respective compressor cold control thermostat, product temperature sensor, and coil temperature sensor will vary somewhat with respect to different kinds of commercially available chilled-product vending machines. However, for the purposes of illustration typical temperatures have been selected as follows. The compressor cold-control thermostat will close to turn on the compressor at approximately 38° F. within the vending machine cabinet. This compressor cold-control switch will open at approximately 18° F. to turn the compressor OFF. The product temperature sensor switch will close at approximately 36° F. to maintain product temperatures of 36° F. or less and to anticipate compressor activity. Closure of the product temperature switch will turn the evaporator fan motors ON. The coil temperature sensor will open at temperatures of 33° F. or greater in order to turn the evaporator fans OFF. The evaporator fan motors will run continuously between the ON signal and the OFF signal due to the overlapping temperature ranges of the product and coil temperature switches.

The product temperature sensor of the present invention set to operate in accordance with the above temperature conditions is effective to stabilize product temperatures within the vending machine unit, determine temperature drift and initiate rapid pull-down or cooling of the products when the need arises.

The coil temperature sensor of the present invention is effective to prevent evaporator coil freeze-up by maintaining the evaporator fans on for a delay period extending beyond the end of the compressor cycle, and due to the fact that the evaporator fans are always on with evaporator coil temperatures below 32° F., will distribute heat throughout the machine cabinet and assist in precluding freeze-up of product in extremely cold ambient environments in which a vending machine is located. That is, the coil sensor will enable the evaporator fans to run continuously during a delay period following each compressor cycle and under extremely cold ambient conditions of the vending machine will cause the evaporator fans to run continuously, thus in effect heating the products up to at least some minimum temperature which will assist in precluding freezing of the same.

BRIEF DESCRIPTION OF THE DRAWINGS

The objects and the attendant advantages of the present invention will become readily appreciated as the same become better understood by reference to the following detailed description when considered in conjunction with the accompanying drawings in which like reference numerals designate like parts throughout the Figures thereof, and wherein.

DETAILED DESCRIPTION OF THE DRAWINGS

Figure 1:
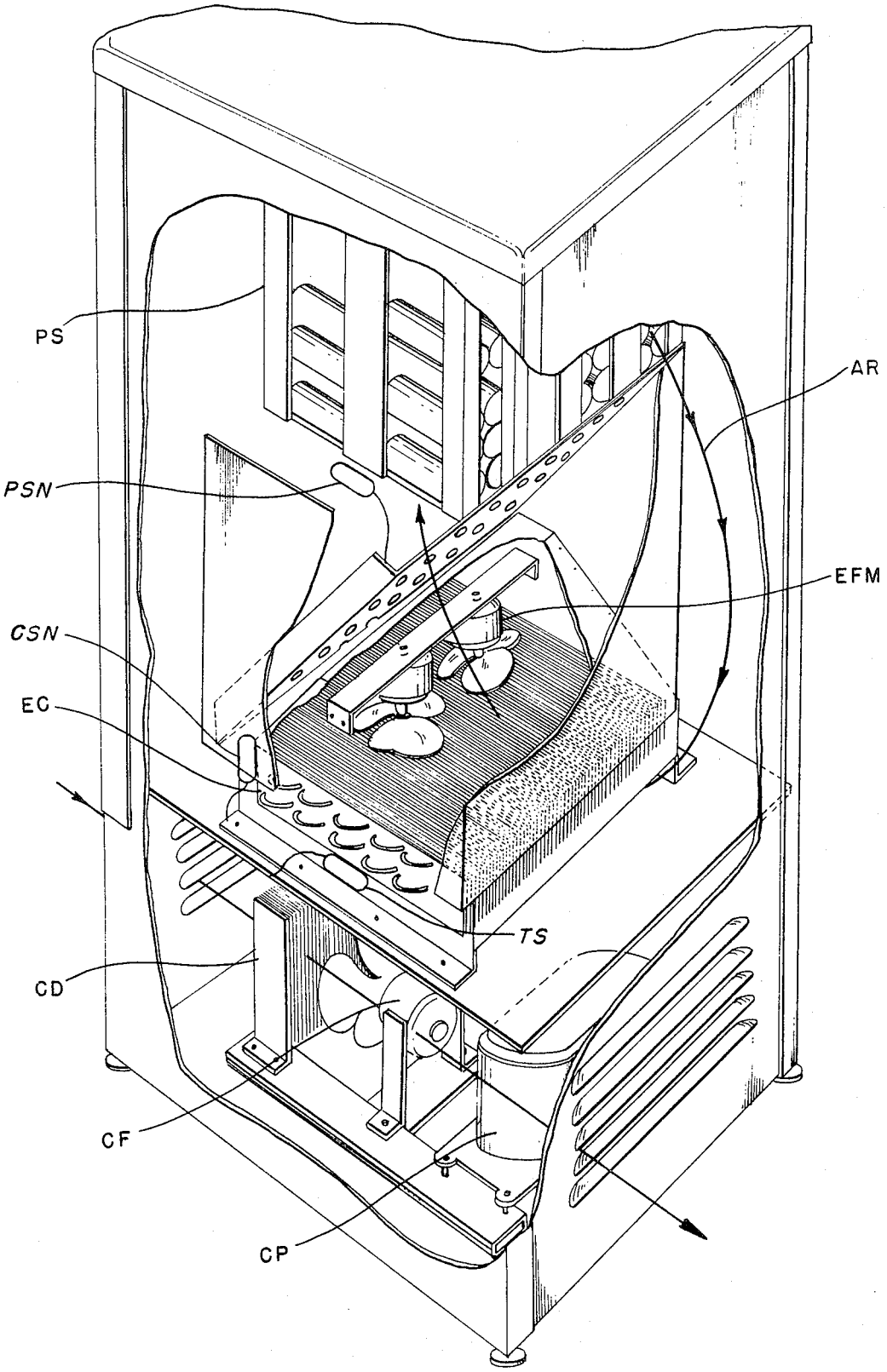
FIG. 1 is a cross-sectional view of the inside of a typical chilled-product vending machine having a convection cooling system.

Referring in detail to FIG. 1, there is generally illustrated in a cut-away view a typical product vending machine wherein a plurality of products such as soft drink cans or bottles are stored in product stacks PS, from which they are sequentially dispensed on demand through appropriate vend slots in the bottom of the vending machine. As illustrated in FIG. 1, the vending machine thereof also includes a convection refrigeration system which includes the conventional components of a refrigeration compressor, having a fan CF and a pump motor CP, condensor coil CD, an evaporator coil EC, evaporator fan motors EFM, and a thermostatic temperature switch TS, for controlling the operation of the refrigeration system in response to the temperatures sensed within the vending machine. The conventional convection refrigeration system illustrated in FIG. 1 operates to chill the products in product stacks PS, by blowing air by means of evaporator fan motor EFM over evaporator coil EC to thereby circulate chilled air between and throughout the product stacks PS. Air returns from the stacks as indicated by arrows AR. In conventional prior art convection refrigeration systems of vending machines known heretofore, the compressor CF, CP is cycled ON and OFF under control of thermostatic temperature switch TS, while the evaporator fan motor EFM runs continuously, even during the periods that compressor CF,CP is de-energized. This continuous running of the evaporator fan motor EFM obviously expends a lot of unnecessary electrical energy and generates heat leading to unnecessary energy waste. Accordingly, in accordance with the objects of the present invention, the control circuit of FIG. 2 was designed to energize the evaporator fan motors EFM only during optimum times when its operation is clearly needed under control of product sensor PSN and coil sensor CSN. For example, in accordance with the present invention, the evaporator fans EFM operate continuously during the period that the compressor C is operating; operate for a predetermined delay period following the cycling OFF of the compressor under control of coil sensor CSN in order to preclude freeze-up of the evaporator coil EC, operate for predetermined periods in advance of cycling ON of compressor CP under control of product sensor PSN anticipating a need for cooling; and are cycled ON to run continuously for coil temperatures below a predetermined limit such as 32° F., to preclude freezing of the products in the vending machine in sub-freezing environmental locations.

Figure 2:
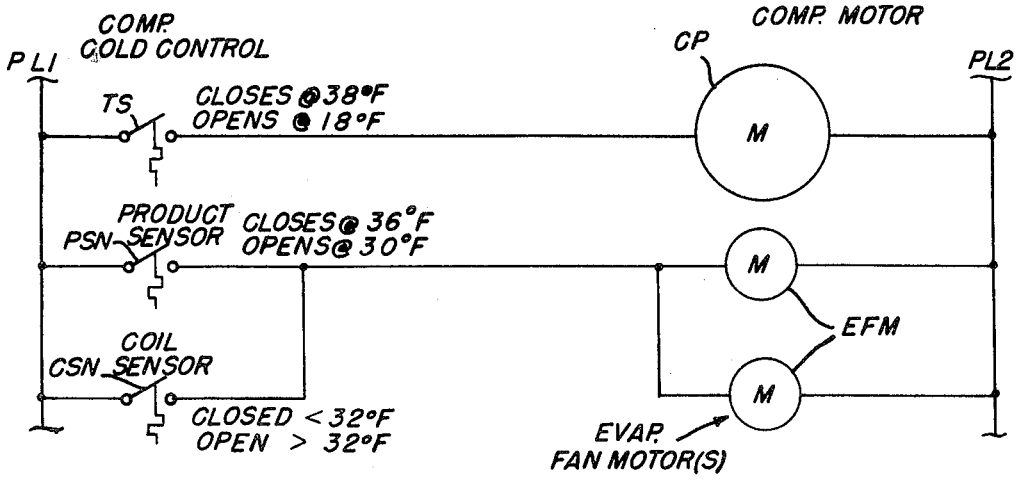
FIG. 2 is an electrical schematic diagram of the temperature-based control circuitry of the present invention for operating the convection cooling system within the vending machine of FIG. 1.

Referring in detail to FIG. 2, there is illustrated an electrical circuit diagram of the control circuitry of the present invention for operating the convection refrigeration system illustrated in FIG. 1. A pair of main power lines PL1, PL2 are provided across which a conventional 120 volt, 60HZ power source is connected. Also connected in parallel between power lines PL1, PL2 are a plurality of temperature sensor switches including: a compressor cold control sensor TS; a product temperature sensor PSN; and a coil temperature sensor CSN. These temperature sensors may be disposed in the locations indicated in FIG. 1.

The respective temperature sensors illustrated in the circuit of FIG. 2 may be bi-metal switches or any other suitable type of temperature switch. The operating temperatures of these switches indicated in FIG. 2 are typical exemplary operating temperatures which may vary somewhat depending on the type of vending machine being controlled. That is, the refrigeration characteristics of the different types of commercially available vending machines may vary and therefore the temperatures to which the respective switches of FIG. 2 are responsive will need to vary somewhat from the examples indicated. As clearly illustrated in FIG. 2, the cold-control temperature sensor for the compressor TS when closed will energize the compressor motor CP and initiate a coolign cycle. In the example shown, switch TS will close at 38° F. and open at 18° F. Thus, compressor cold-control switch sensor TS will define and control the period of the compressor cycle. The product temperature sensor switch PSN and the coil temperature sensor switch CSN are connected in parallel with each other and in series with the evaporator fan motors EFM. There is a slight overlap in their period of operation responsive to overlapping temperature ranges so that these switches in concert control the cycling ON and OFF of evaporator fans EFM. For example, the product temperatures sensor switch closes at 36° F. and opens at 30° F. and the coil temperature sensor switch CSN closes at any temperature less than 32° F. and opens at approximately 33° F. or any temprture which assures that the evaporator coil will not freeze up.

Figure 3A:
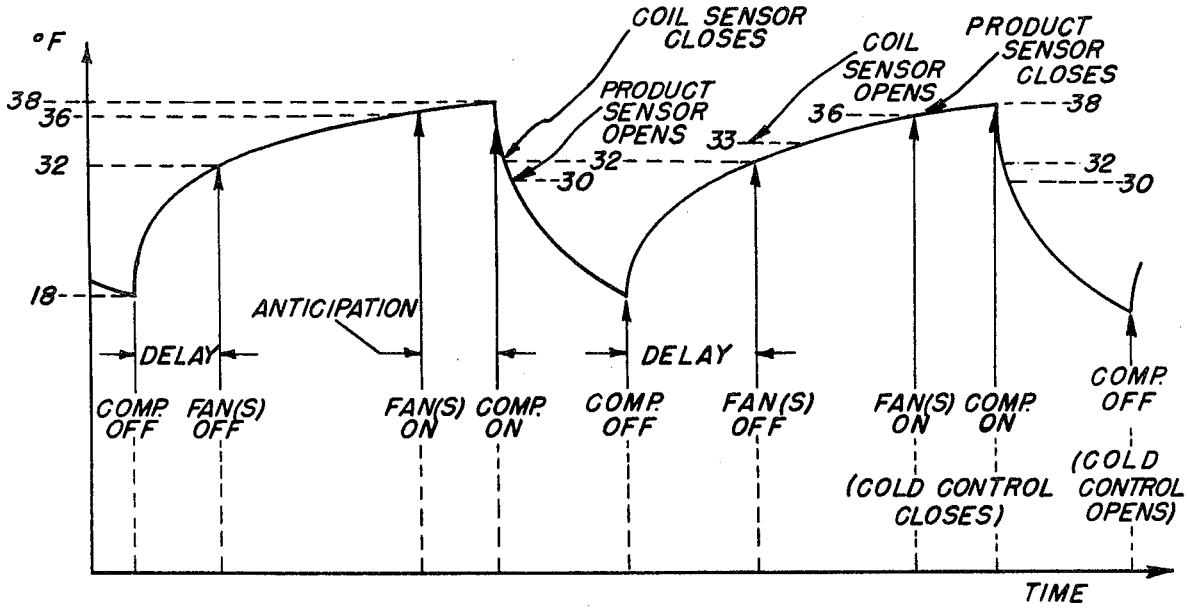
FIG. 3A is a temperature vs. time diagram illustrating the temperatures at which the temperature sensors of FIG. 2 turn ON and OFF and the timing relationship thereof.

The relationship of the temperature ranges illustrated in FIG. 2 will be more clearly understood by reference to FIG. 3A which is a temperature vs. time wave form for typical operation of the refrigeration system for the vending machine of the present invention. The curve illustrated in FIG. 3A is the temperature curve sensed by the cold-control temperature switch TS of the compressor and the vertical arrows illustrate the timed relationship of the opening and closing of the other temperature sensors PSN and CSN.

Figure 3B:
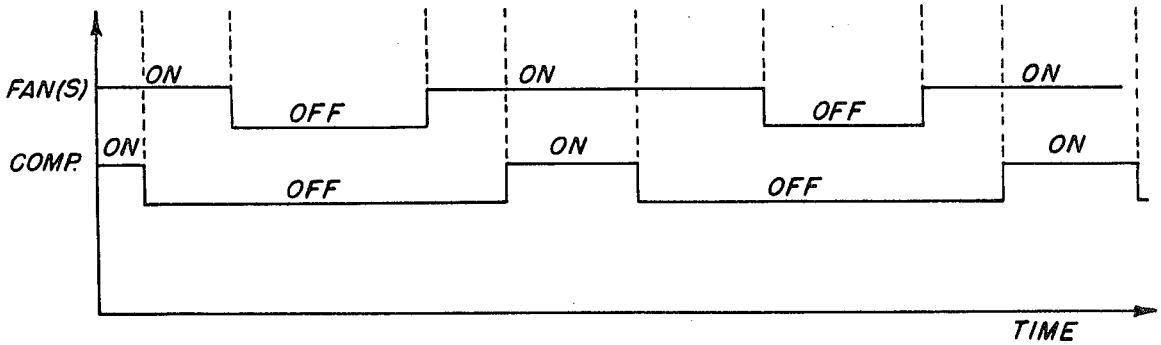
FIG. 3B is a related timing diagram to that of FIG. 3A illustrating the ON and OFF conditions of both the evaporator fan(s) and compressor as controlled by the temperature sensors of FIG. 2.

FIG. 3B further explains the operation of the control circuit of FIG. 2 in conjunction with the waveform of FIG. 3A by illustrating the specific on and off intervals of the evaporator fans EFM and the compressor CF, CP.

As illustrated in FIG. 3A, there is a delay period for evaporator fan motors EFM following the cycling off of the compressor in each instance, the period of which is controlled by the coil temperature sensor switch CSN. That is, in the example shown, the compressor CF, CP will cycle off at approximately 18° F. and as the temperature of the coil sensor switch rises to approximately 33° F. the coil sensor temperature switch will open to discontinue the running of the evaporator fan motors EFM. Thus, the coil temperature sensor switch CSN will control the length of the delay period followig the cycling off of the compressor. Thus, the coil temperature sensor switch of the present invention is effective to preclude freeze-up of the evaporator coil since it forces the evaporator fan motors to remain on following a compressor cycle until the temperature of the evaporator coil stabilizes above the freezing point of water.

In addition, as can be seen from the temperature ranges illustrated in FIGS. 2 and 3A, the coil temperature sensor switch CSN closes whenever the temperature sensed is below 32° F. and constrains the evaporator fan motors to run continuously whenever it is closed. Consequently, if the chilled-product vending machine is disposed in a very cold ambient environment, such as in sub-freezing conditions outdoors, the coil temperature sensor switch CSN will remain closed and the evaporator fans will run continuously. Since this continuous running of the evaporator fan motors will in effect distribute heat throughout the vending machine cabinet, the coil temperature sensor switch of the present invention will also assist in precluding product freeze-up in these particularly cold ambient conditions.

The product temperature sensor switch PSN of the present invention as illustrated in FIGS. 2 and 3A is set to close at approximately 36° F. and open at approximately 30° F. Consequently, the product temperature sensor switch PSN will turn the evaporator fans EFM on to run continuously prior to the beginning of a compressor cycle which begins at approximately 38° F. Therefore, the product temperature sensor switch PSN will define an anticipation period of a predetermined length illustrated in FIG. 3A in advance of the beginning of each compressor cycle. This anticipation period may in effect speed up the time at which the compressor turns on since it causes a temperature stabilization of the environment within the vending machine (a distribution of the cold air then available) thus advancing the time at which the compressor cold-control switch TS senses a 38° F. temperature. It can be seen that this product temperature sensor switch PSN is responsive to both vend rate of chilled-products and therefore can pull down the chilled-product temperature to acceptable limits. The product temperature sensor switch PSN opens at 30° F. removing power from the evaporator fan motors EFM but as can be seen in the parallel circuit arrangement of FIG. 2, coil temperature sensor switch CSN in parallel with product temperature sensor switch PSN has alredy closed at approximately 32° F. and thus takes over the function of continuously energizing the evaporator fan motors EFM during and beyond the comressor cycle.

DESCRIPTION OF OPERATION

Assuming the temperature limits of operation of the respective switches TS, PSN, CSN illustrated in FIGS. 2 and 3A, the refrigeration control system of the present invention would operate essentially as follows:

Once the interior temperature of the chilled-product vending machine reaches approximately 36° F. the evaporator fans EFM turn ON in response to the product temperature sensor PSN anticipating the need for cooling. At approximately 38° F. the compressor CP will turn on under control of compressor cold-control switch TS and run until the compressor cold-control switch TS senses a temperature of 18° F.

Prir to the end of the compressor cycle (at 18° F.), and prior to the end of the energization of evaporator fan motors under control of the product temperature sensor PSN, the coil temperature sensors CSN closes at approximately 32° F. and any temperatures therebelow causing the evaporator fans EFM to run continuously, throughout the compressor cycle, and to continue to run for a delay period until the coil temperature sensor switch CSN opens at approximately 33° F. or any suitable temperature which precludes freeze-up of the evaporator coil.

As the interior temperature within the chilled-product vending machine cabinet increases the above-described cycle will be repated. In addition, if the interior temperature of the vending machine does not increase due to a very cold ambient environment the evaporator fan motors will continue to run generating some heat to avoid product freeze-up.

The temperature sensors of the present invention as stated in hereinbefore may be electromechanical thermostatic types such as bi-metal elements or in the alternative may be solid state temperature sensors which function as switches. If solid state temperature switches are utilized the system of the present invention could be combined or interfaced with the energy management control system of prior application Ser. No. 563,961 filed Mar. 31, 1982 to Morgan, et al.

It should be understood that the system described hereinbefore may be modified as would occur to one of ordinary skill in the art without departing from the spirit and scope of the present invention.

What is claimed is:

1. In a refrigeration system for a chilled product vending machine including a refrigeration compressor, temperature sensor means for detecting the temperature within said vending machine and turning said compressor ON and OFF to define a compressor cycle in response to the detection of predetermined temperature limits, an evaporator coil and evaporator fan means for blowing air across said evaporator coil and circulating said air throughout said vending machine, the improvement comprising:

product sensor means for detecting the temperature of said chilled products and cycling said evaporator fan ON in response to detected product temperatures above a predetermined limit, said predetermined limit being less than the temperature required to turn said compressor ON; and coil sensor means for detecting the temperature of said evaporator coil, and responsive to a coil temperature below a predetermined limit, maintaining said evaporator fan ON during and beyond the end of said comrpessor cycle, and cycling said evaporator fan OFF when the temperature of said coil stabilizes above the freezing point of water.

2. The refrigeration system of claim 1 wherein each of said product sensor means and coil sensor means include an electrical switch connected between a source of electrical power and said evaporator fan, each of said switches supplying electrical power to said evaporator fan when closed and removing said power when open, the respective switches of said product sensor means and coil sensor means being connected in parallel between said source of electrical power and said evaporator fan, whereby electrical power is supplied to said evaporator fan when either of said switches is closed.

3. The refrigeration system of claim 2 wherein the switch of said product sensor means opens in response to the detection of said predetermined minimum product temperature just after the switch of said coil sensor closes in response to said predetermined coil temperature.

4. In a refrigeration system for a chilled-product vending machine including a refrigeration compressor, temperature sensor means for detecting the temperature within said vending machine and turning said compressor ON and OFF to define a compressor cycle in response to the detection of predetermined temperature limits, an evaporator coil and evaporator fan means for blowing air across said evaporator coil and circulating said air throughout said vending machine the improvement comprising:

product sensor means for detecting the temperature of said chilled products and cycling said evaporator fan ON in response to detected product temperatures above a predetermined limit, said predetermined limit being less than the temperature required to turn said compressor ON.

5. The refrigeration system of claim 4, wherein said product sensor means includes an electrical switch connected between a source of electrical power and said evaporator fan, said switch supplying electrical power to said evaporator fan when closed and removing said power therefrom when open.

* * * * *